US005900817A

United States Patent [19]

Olmassakian

[11] Patent Number: 5,900,817

[45] Date of Patent: May 4, 1999

[54] CHILD MONITORING SYSTEM

[76] Inventor: Vahe Olmassakian, 2450 Delisle Ct., Glendale, Calif. 91208

[21] Appl. No.: 09/024,768

[22] Filed: Feb. 17, 1998

[51] Int. Cl.[6] ..... G08B 23/00

[52] U.S. Cl. ..... 340/573.1; 340/573.6; 340/691.6; 379/38

[58] Field of Search ..... 340/573.1, 521, 340/539, 568, 517, 693, 691.6, 573.4, 573.6; 379/38

[56] References Cited

U.S. PATENT DOCUMENTS

| | | | |
|---|---|---|---|
| 4,598,272 | 7/1986 | Cox | 340/573 |
| 4,777,478 | 10/1988 | Hirsch et al. | 340/573 |
| 4,814,751 | 3/1989 | Hawkins et al. | 340/573 |
| 4,961,575 | 10/1990 | Perry | 340/573 |
| 5,025,247 | 6/1991 | Banks | 340/573 |
| 5,086,290 | 2/1992 | Murray et al. | 340/573 |
| 5,223,815 | 6/1993 | Rosenthal et al. | 340/573 |
| 5,289,163 | 2/1994 | Perez et al. | 340/573 |
| 5,461,365 | 10/1995 | Schlager et al. | 340/573 |
| 5,525,967 | 6/1996 | Azizi et al. | 340/573 |
| 5,557,259 | 9/1996 | Musa | 340/573 |
| 5,646,593 | 7/1997 | Hughes et al. | 340/573 |
| 5,650,770 | 7/1997 | Schlager et al. | 340/573 |
| 5,652,569 | 7/1997 | Gerstenberger et al. | 340/573 |
| 5,714,932 | 2/1998 | Castellon et al. | 340/573 |
| 5,742,233 | 4/1998 | Hoffman et al. | 340/573 |

*Primary Examiner*—Nina Tong
*Attorney, Agent, or Firm*—Goldstein & Canino

[57] ABSTRACT

A monitoring system for indicating to a supervisory individual, such as an adult, when a monitored individual, such as a child, has moved beyond a safe predefined maximum distance limit. The monitoring system includes a first electronic module suitably fixed to the monitored individual and arranged to exchange signals that are useful to determine the relative distance and direction the first electronic module is from a suitable second electronic module. The second electronic module, which is in the possession of the supervisory individual, is arranged to exchange signal information with the first electronic module and indicate to the supervisory individual information including when the distance between, and the direction of, the monitored individual. Should the distance between the monitored and supervisory individuals increase beyond the maximum distance limit, an alarm situation may be annunciated by an audio annunciator (or other suitable annunciation device). The second electronic module includes a direction display and distance display, that may be employed by the supervisory individual to locate the monitored individual.

9 Claims, 2 Drawing Sheets

CHILD MONITORING SYSTEM

BACKGROUND OF THE INVENTION

1. Field Of The Invention

The invention relates to personal safety devices. More particularly, the present invention relates to a system to enable one or more supervisory individuals to monitor the location of one or more monitored individuals.

2. Background And Objects Of The Invention

Personal safety devices are well known in the art and provided in many forms. However, there is a need for simple, capable systems, and associated devices, to enable a supervisory individual, such as a parent, to quickly locate a monitored individual, such as a child, as required.

For example, assume a parent and child are in a park, and the parent is distracted for a moment. During this time the child moves off to play on another item in the park, say a slide provided a short distance away. Next, the child moves to yet another play item. Thus, in a possibly relatively short period of time the child and parent may be separated by a somewhat significant distance. It may even be possible that the child is now out of the line-of-sight of the parent. Upon realizing the child has moved (possibly out of sight), the parent may panic and actually head off in the wrong direction, thereby increasing the distance to the now unsupervised child. Therefore, even if the child is actually nearby, a disaster may result.

When considering the current technology available, especially with regard to the level of miniaturization that is possible with electronic circuits and modules constructed with such circuits, devices and systems are providable that can address this and other 'monitoring' concerns. Further, such systems should be readily providable at reasonable costs and embodied in rugged and reliable constructions.

Objects of the present invention are, therefore, to provide new and improved monitoring systems having one or more of the following capabilities, features, advantages, and/or characteristics:

- a reliable and low maintenance system using available technology;
- a modular wireless based architecture;
- provides a first electronic module associated with a monitored individual and a second electronic module associated with a supervisory individual;
- provides distance and direction related information to the supervisory individual (regarding the monitored individual)
- supports the annunciation of distance related alarm situations;
- supports the annunciation of other types of alarm situations;
- simple and economical construction;
- very simple to use.

The above listed objects, advantages, and associated novel features of the present invention, as well as others, will become more clear from the description and figures provided herein. Attention is called to the fact, however, that the drawings are illustrative only. Variations are contemplated as being part of the invention, limited only by the scope of the appended claims.

SUMMARY OF THE INVENTION

In accordance with the invention, a monitoring system for indicating to at least one supervisory individual, such as an adult, when a monitored individual, such as a child, has moved beyond a predefined (safe) maximum distance limit. The monitoring system includes a first electronic module suitably fixed to the monitored individual and capable of emitting and receiving signals that are useful to determine the relative distance and direction the first electronic module is from a suitably configured second electronic module. The second electronic module, which is in the possession of the supervisory individual, is arranged to exchange information, via the signals, with the first electronic module to indicate to the supervisory individual any one of several possible pieces of information. For example, a supervisory individual may be presented with the distance between the monitored individual and supervisory individual. An alarm situation may be annunciated should the monitored individual move away from the supervisory individual and beyond the maximum distance limit. The second electronic module is also contemplated to include a direction display to indicate to the supervisory individual the proper direction to move to decrease the distance to (or between) the monitored individual. An alarm situation may be annunciated by an audio indication, the activation of a vibratory means, and or the activation (and possible flashing) of an optical annunciator.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of many possible arrangements utilizing the fundamental concepts of the present invention. As such, the embodiments illustrated should be considered illustrative only. The drawings are briefly described as follows.

LIST OF REFERENCE NUMERALS USED IN THE DRAWINGS

10—bracelet (with first electronic module)
12—first electronic module
16—moisture sensor
20—second electronic module
22—direction display
22*a*—direction arrow (direction indication means)
22*b*—direction arrow (direction indication means)
24—optical annunciator (incandescent, LED, etc.)
26—distance display
30—switch means
30*a*—on-off switch (possibly recessed)
30*b*—select (function) push-button
30*c*—adjust (push-button) switches
40—child (monitored individual)

DETAILED DESCRIPTION OF THE PREFERRED EMBODIMENTS

It is important to establish the definition of several important terms that will be used throughout this disclosure. The term 'electronic module', as applied herein when discussing the first and second electronic modules, is intended to define modules providable by skilled persons, which will include electrical components such as integrated circuits, transistor, capacitors, resistors, etc. As skilled persons will appreciate, such modules are generally well known in the art, and when considered with the information provided in the following disclosure, may be embodied in a number of varying circuits, employing one or more available technologies. For example, the use of global positioning satellite (GPS) technology is contemplated to be employed in possibly preferred embodiments of each of the first and second electronic modules to determine the distance and direction between the respective electronic modules (as will be addressed below). The term 'supervisory individual' will be defined as any person charged with the responsibility and care of at least one other individual. This other individual, which is under the supervision of a supervisory individual, will be termed a 'monitored individual'. For example, a supervisory individual may actually be a parent or a baby-sitter, while a monitored individual would often be an infant or child. Other terms will be provided and defined as necessary.

Figure 1:
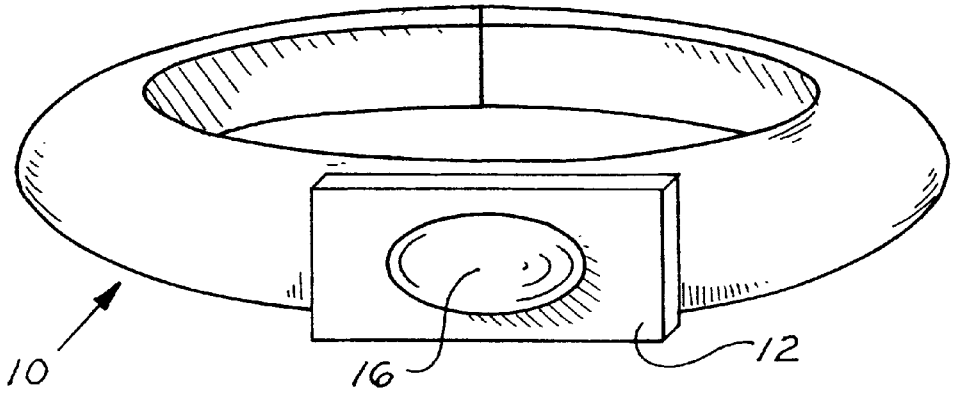
FIG. 1 provides an elevated perspective view of an embodiment of a first electronic module of the present invention.
Figure 3:
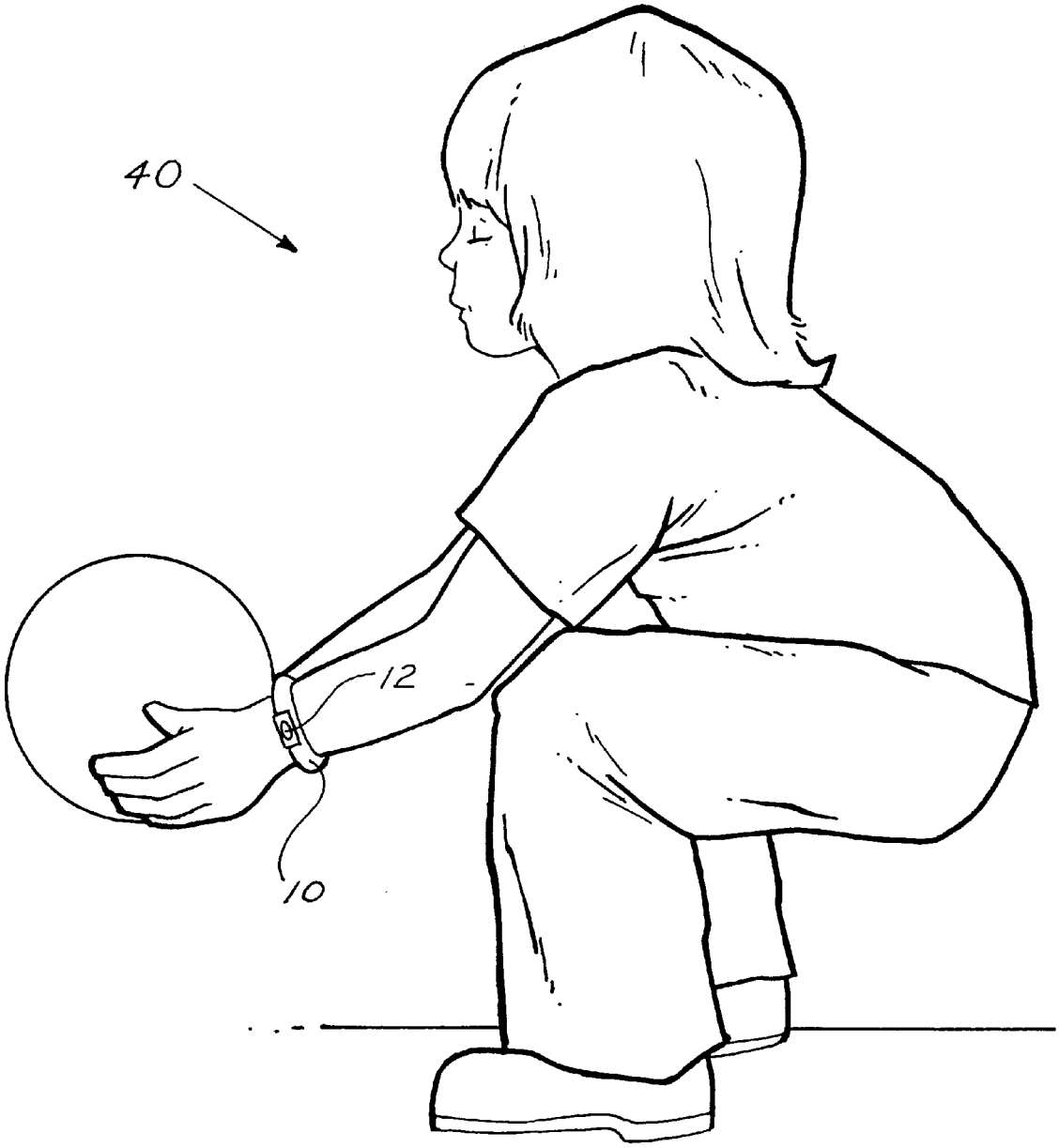
FIG. 3 illustrates a view of a monitored individual having fixed thereto the first electronic module depicted in FIG. 1.

Referring now to FIG. 1, there is illustrated a bracelet 10 having a first electronic module 12 fixed to the bracelet. The first electronic module 12 is configured to receive and emit signals, for example, say, radio frequency or other known signals, that are useful to determine the relative distance and direction the first electronic module 12 is from a suitable second electronic module 20. The signals received and emitted may be processed and employed, as will be appreciated by skilled persons, to enable distance and direction determinations to be made. As can be seen in FIG. 3, the bracelet 10 may be worn by a monitored individual, such as the child depicted. Alternately, the first electronic module 12 may be fixed to the monitored individual via a necklace or other known and suitable arrangements available in the art. In a preferred embodiment the first electronic module 12 may be provided as an anklet (not shown). It should also be noted that the first electronic module 12 may be provided in an arrangement similar to that of a wrist watch, wherein the first electronic module 12 is 'strapped' to the individual to be monitored by the equivalent of a watchband type of a structure.

Figure 2:
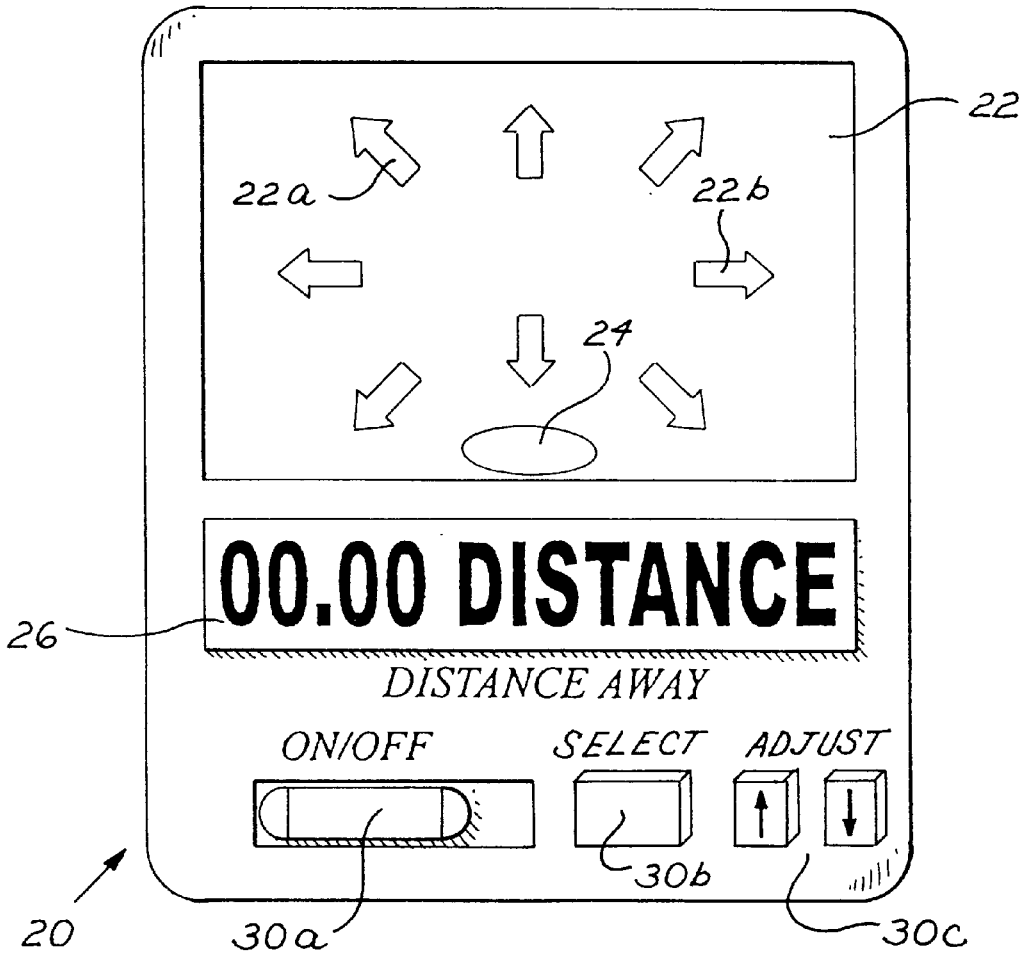
FIG. 2 depicts an embodiment of a second electronic module of the invention.

As can be seen in FIG. 2, a second electronic module 20 is included with the monitoring system of the present invention. The second electronic module 20, which would be in the possession of a supervisory individual, is arranged to exchange information (via the signals exchanged) with the first electronic module 12, and apply the information to indicate to the supervisory individual at least one of several possible pieces of information. For example, a supervisory individual may be presented with one of the distance between the monitored and supervisory individuals, what direction the supervisory individual should move to decrease the distance to the monitored individual, and or when the monitored individual becomes 'wet'. In addition, the second electronic module 20 may be arranged to annunciate the existence of an alarm situation should the distance between the monitored individual and supervisory individual increase beyond a predefined maximum distance limit. As can be seen in FIG. 2, a display means is included that may be embodied by a direction display 22 and a distance display 26. The direction display 22 may include a plurality of omni-oriented direction indicating arrows, such as direction arrows 22*a* and 22*b*, that are configured to cover a full 360 degree (direction) range. Accordingly, one or more direction arrows of the direction display 22 may be lit to indicate to the supervisory individual what direction the supervisory individual should move to decrease the distance to the monitored individual's current location. The distance display 26, which may be employed to display non-direction related information by using the select switch 30*b* (or an equivalent), is contemplated to generally display the actual distance between the supervisory individual and the monitored individual. Accordingly, the distance and direction displays, as well as other possible display means that may be provided with the present invention, are contemplated to be updated in real-time to provide the supervisory individuals with nearly instantaneous updates of the displayed information. The information updates are realized by the receiving and emitting of the signals discussed above. Other switch means, including the on/off switch 30*a*, may be provided as required.

It should be noted that the supervisory individual may employ and the select switch 30*b*, along with the adjust switches 30*c*, to select and adjust various parameters associated with the monitoring system of the present invention. For example, the second electronic module 20 may be configured to enable the supervisory individual to adjust the predefined maximum distance limit beyond which an alarm situation will be annunciated. For example, the select switch 30*b* and the adjust switches 30*c* may enable the supervisory individual to select the maximum distance limit to be utilized in, say, 10 feet increments. Additionally, other settings, such as the volume of an audio annunciation, or the length of time of an annunciation, may be set.

As further shown in FIGS. 1 and 3, the present invention may be configured with a moisture sensor 16. The moisture sensor 16 may be included to detect if the monitored individual becomes wet or submerged in water. For example, if the monitored individual should fall into a pool of water, or the like, an alarm situation can be annunciated to the supervisory individual via the second electronic module 20. The supervisory individual may then employ the direction display 22 to locate the monitored individual.

It should be noted that it is contemplated that the annunciation of an alarm situation may be provided as any one of an audio annunciation (by way of an audio sounder device), a vibratory annunciation (by way of a suitable vibration producing device), and or as an optical annunciation (by way of optical annunciator 24 of FIG. 2). Accordingly, the second electronic module 20 would need to include such devices as may be required for a specific embodiment. Also, once an alarm condition or an alarm situation has occurred, the supervisory individual would typically have to cancel the annunciation before the alarm situation is canceled. For example, if a monitored individual moves beyond the maximum distance limit and an alarm situation is annunciated, it is preferred that the alarm situation lead the supervisory individual directly to the monitored individual, regardless of whether the distance between the supervisory and monitored individual should be decrease below (and within) the maximum distance limit. Accordingly, once the supervisory individual has located the monitored individual, the alarm situation would be manually canceled by the supervisory individual (say via select switch 30*b*).

In an alternate embodiment of the monitoring system of the present invention, a system is contemplated wherein a plurality of supervisory individuals are monitoring a plurality of monitored individuals. In this embodiment, each of the first electronic modules 12 may assigned a unique 'identification number' to support the system operation. An alarm situation may be generated with this alternate embodiment should any of the monitored individuals move beyond a maximum distance limit, as applied, or determined with regard to, any of the supervisory individuals. This second embodiment of the present invention may be employed, for example, if a group of children go on a field trip, or the like.

It is important to understand that the above description of the monitoring system, including the first electronic module 12 and the second electronic module 20 of the present invention, are exemplary only, and other equivalent arrangements may be provided by skilled artisans. Therefore, while the currently preferred embodiments of the present invention have been described, those skilled in the art will recognize that other and further modifications may be made without departing from the present invention. Accordingly, it is intended to claim all modifications and variations as fall within the scope of the invention.

What is claimed is:

1. A monitoring system for indicating to a supervisory individual, that is an adult, when a monitored individual, that is a child, has moved beyond a predefined maximum distance limit, the monitoring system comprising:

a) a first electronic module suitably fixed to the monitored individual, and including means for emitting and receiving signals that are useful to determine the relative distance and direction the first electronic module is from a second electronic module; and b) the second electronic module in the possession of the supervisory individual, arranged to exchange information via the signals exchanged with the first electronic module and apply the information to indicate to the supervisory individual at least one of:

i) the distance between the monitored individual and supervisory individual;

ii) the direction for the supervisory individual to move to decrease the distance to the monitored individual;

iii) if the monitored individual has become wet; and iv) when the distance between the monitored individual and supervisory individual increases beyond the maximum distance limit;

wherein the first electronic module is miniaturized and provided as a portion of at least one of:

a) a necklace;

b) a bracelet; and c) an anklet;

wherein global positioning satellite system is employed with each of the first and second electronic modules to determine the distance and direction between the electronic modules;

wherein a moisture sensor is included to determine if the monitored individual becomes wet or submerged in water, thereby causing an alarm situation to be annunciated.

2. The monitoring system according to claim 1, wherein the second electronic module enables the maximum distance limit beyond which an alarm will be generated to be adjusted.

3. The monitoring system according to claim 2, wherein a visual display is provided indicating the direction the supervisory individual should move to decrease the distance to the monitored individual's location.

4. The monitoring system according to claim 3, wherein the supervisory individual is notified of an alarm situation by at least one of:

a) an audio annunciation;

b) a vibratory annunciation; and c) an optical annunciation.

5. A group monitoring system for indicating to at least one of a plurality of supervisory individuals when the distance between the respective supervisory individual and at least one monitored individual equipped with a first electronic module has increased beyond a predefined maximum distance limit, the monitoring system comprising:

a) a respective first electronic module is fixed to a respective monitored individual and said first electronic module is capable of receiving and emitting signals that are useful to determine, either directly of indirectly, the relative distance and direction the first electronic module is from a second electronic module capable of receiving and emitting the signals; and b) a plurality of second electronic modules, each supervisory individual carries a respective second electronic module, each second electronic module arranged for receiving, processing, and emitting the signals to effect the exchange of information with at least one of first electronic modules to indicate to the supervisory individuals at least one of:

i) when the distance between the respective monitored individual and at least one supervisory individual has increased beyond the maximum distance limit;

ii) the direction the respective supervisory individuals should move to decrease the distance between the respective monitored individual causing an alarm situation; and iii) the linear distance between at least one of the supervisory individuals and the respective monitored individuals that causing the alarm situation;

wherein global positioning satellite system is employed with each of the first and second electronic modules to determine the distance and direction between the electronic modules.

6. The group monitoring system according to claim 5, wherein a visual display provided with said each second electronic module to indicate:

(a) the direction the supervisory individual should move to decrease the distance to the location of the respective monitored individual causing the alarm situation; and (b) the present distance to between the supervisory individual and the monitored individual.

7. The group monitoring system according to claim 5, wherein the second electronic module enables the maximum distance limit beyond which an alarm will be generated to be adjusted.

8. The group monitoring system according to claim 5, wherein the supervisory individual is notified of the alarm situation by at least one of:

a) an audio signal;

b) the activation of a vibratory device of the electronic module, thereby providing a vibration detectable by the supervisory individual 'wearing' the respective second electronic module; and c) the activation of an optical annunciator.

9. The group monitoring system according to claim 8, wherein the alarm situation is annunciated until a switch means of the second electronic module is activated.

* * * * *